US010198910B2

(12) United States Patent
Theodosopoulos

(10) Patent No.: US 10,198,910 B2
(45) Date of Patent: Feb. 5, 2019

(54) TOURNAMENT STYLE IN-PLAY SPORTS BETTING WITH REAL TIME LEADERBOARD TRACKING

(71) Applicant: Theodoros Theodosopoulos, Agrinio (GR)

(72) Inventor: Theodoros Theodosopoulos, Agrinio (GR)

( * ) Notice: Subject to any disclaimer, the term of this patent is extended or adjusted under 35 U.S.C. 154(b) by 102 days.

(21) Appl. No.: 15/382,905

(22) Filed: Dec. 19, 2016

(65) Prior Publication Data

US 2017/0103615 A1 Apr. 13, 2017

(51) Int. Cl.
*G07F 17/32* (2006.01)

(52) U.S. Cl.
CPC ..... *G07F 17/3288* (2013.01); *G07F 17/3244* (2013.01); *G07F 17/3276* (2013.01)

(58) Field of Classification Search
USPC ..... 463/25, 26
See application file for complete search history.

(56) References Cited

U.S. PATENT DOCUMENTS

2010/0190538 A1* 7/2010 Siewert ..... A63F 5/00 463/2

2016/0133088 A1* 5/2016 Givant ..... G07F 17/3237 463/25

* cited by examiner

*Primary Examiner* — Pierre E Elisca
(74) *Attorney, Agent, or Firm* — Franco S. De Liguori; DP IP Group

(57) ABSTRACT

The disclosure discloses an improved online betting system platform for making in-play sports betting wages. In accordance with an exemplary embodiment, the platform is configured to identify a request by a player to join a tournament with a predefined entry fee and compete for rewards derived as a function of predefined entry fees by a wager pool of players betting on the same tournament. Once the request to join is acknowledged by the platform, the player is automatically added to the list alongside all the other wager pool of players registered for the tournament. Thereafter, the platform displays sporting event information including different bet types that can be waged on the basis of the predefined entry fee, and updates the sporting event information in real time in response to in-play activities associated with the live sporting event. The platform recognizes and records player bets up to the limit of the predefined entry fee and tracks winning and losing bets in real time. A leaderboard automatically calculates the winnings of the wager pool of players and displays, in real time fashion, the current leaders, in terms of winnings, during the tournament. The leaderboard updates the leaderboard automatically during the tournament to reflect changes in leaderboard standings in response to placed bets settling and clearing, as well as in response to real time changes in odds of still pending bets.

16 Claims, 10 Drawing Sheets

400

7 Leaderboard
See how you do against other players on the leaderboard.
410

8 Add-On
Out of chips? Click on the 'Add-On' button to add extra funds and keep fighting for the prize.
420

9 Rebuy
Got eliminated? Now never stay out of the game, by clicking on the 'Rebuy' button you rejoin the game.
430

600

700

TOURNAMENT STYLE IN-PLAY SPORTS BETTING WITH REAL TIME LEADERBOARD TRACKING

FIELD

The present disclosure relates to online sports betting platforms and systems, and in particular, multi-player tournament type sports betting.

BACKGROUND

Sports betting is the activity of predicting sports results and placing a wager on the outcome. Traditional (or "offline") betting involving multi-player tournament type sports betting is well known. The proliferation of computers, and web-based technology in particular, has led to the popularity of "online sports betting" in recent years. Fixed odds betting is a type of sports betting where bets are placed by players through various electronic gaming platforms, including online internet gaming operators and retail gaming establishments.

In both traditional and fixed odds betting, the type of bet and corresponding betting odds are set by a bookmaker (also known as "bookie"). Fixed odds betting is also sometimes referred to as "in-play sports betting" or "in-play tournament sports betting" as bets are made while tournaments are in-play.

Due to the sheer volume and variety of "in-play" bets available with fixed odds betting, bets are typically set by electronic algorithms designed to account for a large number of variables and events as they occur, in real time. The same algorithms are designed to statistically guesstimate a result and convert this result into a risk-reward outcome for each bet. The generation of so-called "odds" are based on this risk-reward determination. An in-play sports betting platform will typically offer players options to make wages using a variety of different types of bets familiar to experienced players.

Due to the large number of bets offered in in-play sports betting, platform owners place significant emphasis in providing a well-designed user interface the aim of which is to allow players to (i) easily discern between the types of bets, (ii) is friendly in terms of the player placing multiple bets, and (iii) allows players to make snap judgments with respect to future wages or changes to existing wages.

A well laid out in-play sports betting platform interface normally will provide a complete player betting experience and an abundant set of betting selections (bets). Enhancing the experience by adding more functionality can make navigating through player selections difficult, may require moving content to other pages, or even eliminating some bets to reduce the overall complexity of the in-play experience. As a result—and also because players are distrustful of in-play sports betting platforms that don't fall in line with industry customary look and feel user interfaces—adding new functionalities is very uncommon.

With the proliferation of in-play betting platforms and the inclination of platform owners to stick to a user interface that will be familiar to prospective players, platform UIs tend to offer very similar bet selections and similar set of functionalities. To many platform owners this is desirable in that new players do not have a great learning curve when joining a new platform to make wagers. On the flip side, by not adding functionalities, many platforms today suffer in that they provide a stale player experience with no new clever and fun offerings to capitalize on the in-play sports betting aspects that have been around for so long.

It is desirable to be able to adapt fixed odds betting platforms to include innovative new functionalities. It is further desirable to be able to integrate the new functionalities into an existing UI platform in a way that does not compromise or substantially change the player experience with which the player is familiar.

In addition to the look and feel and UI aspect of a platform, it is important when adding functionalities to not limit or restrain the number of different types of bets normally offered by the various platforms. By way of background, the different types of bets available to players today include:

Moneyline Betting: Moneyline bets are bets that do not have a "handicap". The favored team in a moneyline type bet pays lower odds than does the underdog; also, odds for different outcomes in a single moneyline bet are related to the ratio of full payout to the "stake".

Handicap Betting: Handicap betting involves giving a selection a virtual deficit (a handicap or "spread") to overcome at the start of an event. Choosing a different selection, which does not have a handicap, implicitly gives the different selection a virtual start in the event. When a wager is placed on a selection with a handicap, the winner is determined by adding the selection score and the handicap and comparing the combined result to the score of the opponent.

The purpose of a handicap is to "even up" the odds in a match where one selection is statistically "inferior" to that of an opponent selection.

Proposition Betting: Proposition bets are wagers made on a very specific outcome of a match. Examples include predicting the number of goals each team scores in a soccer match, betting whether a player will score in a soccer game, or wagering that a soccer player on one team will accumulate more hits than a player on the opposing team.

Parlay Betting: Parlay bets involve a player placing multiple bet selections (usually up to 12). When a player makes multiple bet selections, the risk rewards are such that a successful player is awarded with a large payout. To give an example, a player could include four different wagers in a four-team parlay, whereby he is wagering that all four bets will win. If any of the four bets fails to cover, the player loses the parlay, but if all four bets win, the player receives a substantially higher payout than if he made the four wagers separately.

A progressive parlay is special type of parlay bet. In a progressive parlay—unlike a regular parlay—reduced payouts are awarded even when some of the bet selections lose.

A teaser type bet allows a player to combine bets on two or more different games. In a teaser bet, a player is able to adjust the point spreads for, for example, two games, but must get all the games correct to win and recognizes a lower return in comparison to parlays.

An "if bet" consists of at least two straight bets joined together by an "if clause" which determines the wager process. If the player's first selection complies with the condition (clause), then the second selection will have action; if the second selection complies with the condition, then the third selection will have action and so on.

Some bets, such as goal line bets are wagers offered as alternatives to straight-up/moneyline prices in, for example, soccer. Goal line type bets feature a fixed point spread that (usually) offers a higher payout for the favorite and a lower payout for the underdog (both in comparison to the moneyline).

While all sports wagers are by definition on future events, bets listed as "futures" generally have a long-term horizon measured in weeks or months; for example, a bet that a certain team will win the upcoming season.

In "Head-to-Head bets", players predict competitor results against each other (i.e., the competitors) and not on the overall result of the event. A player can also wage on a tie in some cases. A 2nd half (Second half) bet is also sometimes called a halftime bet. This bet is placed only at halftime of a particular sporting event. This bet may be placed on the spread (Line) or over/under. The resulting bet that is placed is won or lost only on the points scored by both teams in the second half only.

In totalizators (sometimes called flexible-rate bets), the odds are changing in real-time according to the share of total exchange each of the possible outcomes have received taking into account the return rate of the bookmaker offering the bet. For example: If the bookmakers return percentage is 90%, 90% of the amount placed on the winning result will be given back to players and 10% goes to the bookmaker. Naturally, the more money bet on a certain result, the smaller the odds on that outcome become. In horse racing and dog racing, this is known as pari-mutuel wagering.

Given the wide range in terms of types of bets that may be offered by an in-play sports betting platform, the bookmaker is required to continuously set and update odds for all available bets.

Some platforms independently create and display odds selections. In other platforms, odds are set by a third party bookmaker service and served as an electronic feed to subscribing feed platforms. When receiving third party bookmaker feeds, some platform owners may opt to modify fed results in order to adjust the odds slightly to offer players slightly more attractive winnings, as a way to attract new members.

Notwithstanding the type of bookmaking mechanism selected by a platform owner, a common characteristic of in-play sports betting platforms is the inclination to stick to a user interface that's familiar to prospective new members and which, at the same time, is configured to visually support the display of a large number of bets in a user-friendly manner.

While, as above described, it is desirable to be able to add new functionalities and yet still support the different types of bets in a user friendly way, it is further desirable that the adding of new functionalities not adversely impact the bookmaking feed mechanism chosen by a platform owner.

In setting odds, the bookmaker is generally concerned that the probability implied by the odds is greater than the true probability for each possible outcome so the is positive expected profit. If wagers on each outcome are made in ratio to the implied odds, then the bookmaker is guaranteed a profit (balanced book).

An unbalanced book means that the odds set did not result in a positive profit for a certain set of bets over a given period. When this happens, the platform owner will have losses.

It is desirable to be able to introduce new functionalities to fixed odds betting which eliminate or reduce the risk of losses to platform owners.

In general, in-play sports betting has become so ubiquitous that players have a wide variety of online internet operators from which to choose. As such, in order to remain competitive and not lose players to another internet operator, bookmakers must and do, for the most part, offer pay out terms in fixed odds betting that are very similar. Despite this, there is no guaranteed way that a bookmaker's odds will not bring about substantial losses to a platform owner. This is particularly the case when the volume, in terms of players and player wages, is low in relation to another platform with a higher number of players and wages that is better able to absorb losses.

One way platforms susceptible to low volume losses mitigate risk is to pool bets from different internet operators, or outsourcing the bookmaking to a third party that is large enough to be able to absorb the risk. One benefit of this is that bet types, and in some cases also the odds, are common across many online gaming operators, and no one operator is disadvantaged in not offering players bet types that another offers. Also, it affords smaller operators the opportunity to appear as large gambling establishments, giving the players a sense of security that their wagers are safe. The problem is that by associating with third party bookmakers, profit margins are squeezed.

To compete with larger or more popular platforms, fixed odds betting platforms often seek to entice new members by offering bonus money for "free play" as well as other incentives. The problem is that bonuses squeeze profits further when overall player wager activities fail to generate the desired level of real wagering and the incident profits therefrom to cover the costs of incentives.

Accordingly, it is further desirable to be able to add functionalities to fixed odds betting platforms that eliminate or reduce the need for bonuses as incentives.

The attraction and ubiquity of fixed odds betting, as opposed to non-fixed odds betting, is in large part attributed to the fact that a player, in theory, can reduce the risk of losses—and conversely, increase the chances of winning—by factoring one's knowledge of sports, teams, players, statistics, etc. into the wage selection process.

It is further desirable that the adding of new functionalities enhance the overall player experience without restricting user's personal knowledge in the wager decision.

SUMMARY

The present disclosure is directed to an improved fixed odds betting platform for making in-play sports betting wages. In accordance with an exemplary embodiment, the platform is configured to identify a request by a player to join a tournament with a predefined entry fee and compete for rewards derived as a function of predefined entry fees by a wager pool of players betting on the same tournament.

Once the request to join is acknowledged by the platform, the player is automatically added to the list alongside all the other wager pool of players registered for the tournament.

Thereafter, the platform displays sporting event information including different bet types waged based on a predefined entry fee, and updates the sporting event information in real time in response to in-play activities associated with the live sporting event.

The platform recognizes and records player bets up to the limit of the predefined entry fee and tracks winning and losing bets in real time.

A leaderboard automatically calculates the winnings of the wager pool of players and displays, in real time, the current leaders, in terms of winnings, during the tournament. The leaderboard updates automatically during the tournament to reflect changes in leaderboard standings in response to placed bets settlement and clearing, as well as in response to real time changes in odds of still pending bets.

In accordance with the proposed exemplary embodiment, the leaderboard introduces new functionality to facilitate enriched experience in-play sports betting with players competing against each other for the right to draw winnings from the total predefined entry fees paid by the participant wager pool of players associated with the tournament.

By not having players place bets against the bookmaker (i.e., the platform), the tournament approach to in-play sports betting eliminates the payout risk to the platform and limits winnings to tournament generated entry fees.

These and other features and advantages of the present invention will be apparent from the description of exemplary embodiments provided herein.

BRIEF DESCRIPTION OF THE DRAWINGS

Purposes and advantages of the exemplary embodiments will be apparent to those of ordinary skill in the art from the following detailed description, in conjunction with the appended drawings, in which like reference characters are used to indicate like elements, and in which.

DETAILED DESCRIPTION

The word "exemplary" is used herein to mean "serving as an example, instance, or illustration." Any embodiment described herein as "exemplary" is not necessarily to be construed as preferred or advantageous over other embodiments.

The following description is intended to convey a thorough understanding of the embodiments described by providing a number of specific embodiments and details involving methods and systems for managing content submission and publication of content. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending upon specific design and other needs.

The terminology used herein is for the purpose of describing particular embodiments only and is not intended to limit the scope of the present invention. As used throughout this disclosure, the singular forms "a," "an," and "the" include plural reference unless the context clearly dictates otherwise. Thus, for example, a reference to "a module" includes a plurality of such modules, as well as a single module, and equivalents thereof known to those skilled in the art.

In accordance with an exemplary embodiment, an improved gaming platform is proposed, combining competition tournament play with live in-sports betting, but at the same time employing leaderboards in a totally new and clever way.

Competition tournaments are not new in online gaming. Poker tournament playing is the most common and popular type of wagering. Despite this fact, we have not seen in-play sports betting offered in tournament form.

One version of in-play betting with players competing against each other is disclosed in U.S. Pat. No. 7,740,539, issued to Burt Simon. Simon describes a multi-player online wagering system that supports wagering on multiple live games simultaneously and doing so in the form of tournaments, where the pool of money wagered for a given tournament by the players competing in the tournament, is shared among tournament winners.

What Simon and other tournament type in-play betting platforms do not provide, is a leader board, of the type proposed in the present application. A leaderboard allows players to look at the betting choices made by other tournament players, player winnings and rankings, and much more.

While the use of tournament leader boards in online betting is not new, it has not been adopted in in-play betting tournament type wagering in the unique manner proposed below. Thus, one reason that despite the wide proliferation of tournament wagering in online gaming platforms, the concept of in-play sports betting in a competition tournament format has not caught on.

Figure 1:
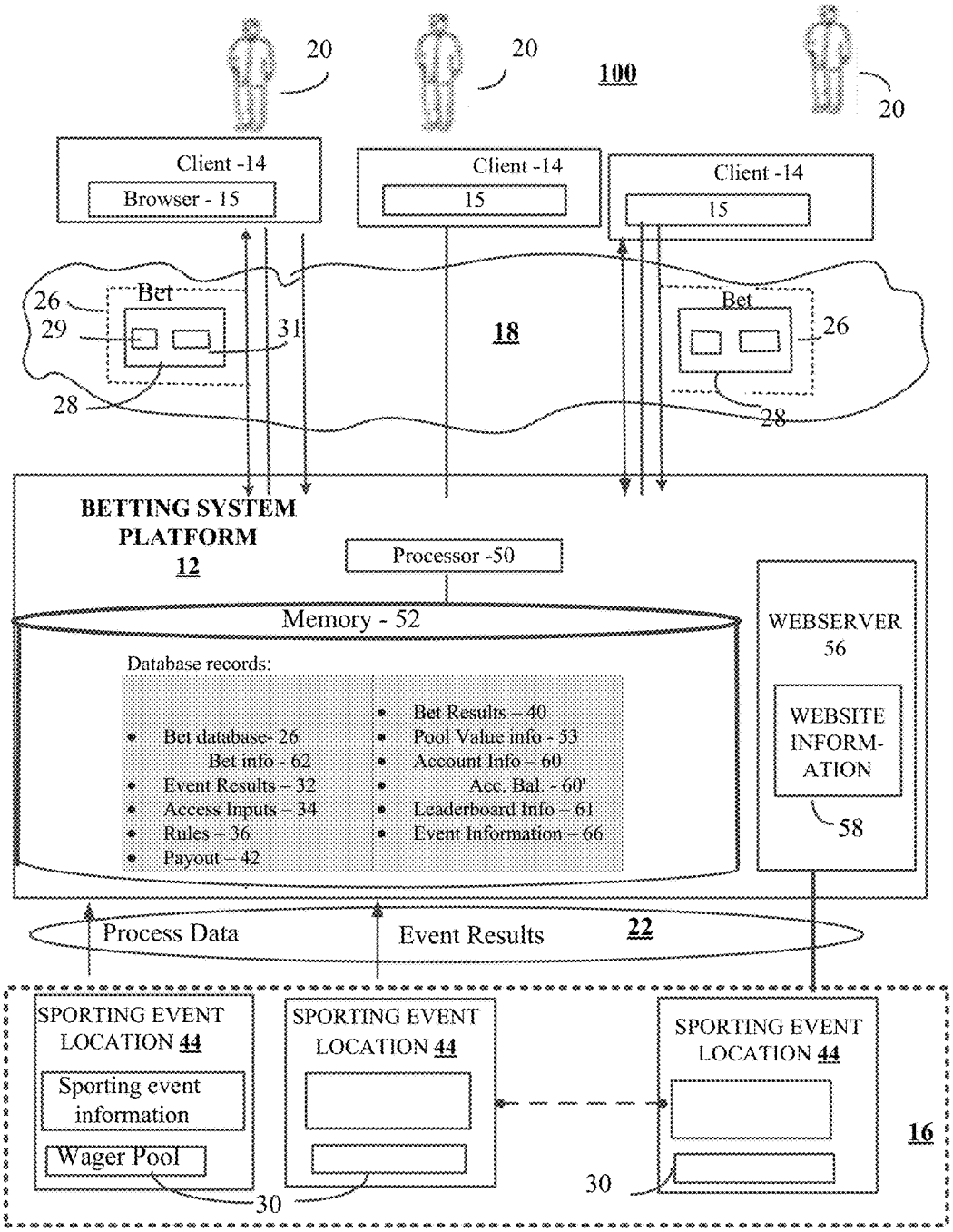
FIG. 1 is an example system for providing tournament type in-play sports betting in accordance with an embodiment of the present invention.

FIG. 1 is an example system 100 for providing tournament type in-play sports betting in accordance with an embodiment of the present invention.

In general, system 100 allows users to place bets for which the results of such bets are determined at least in part by the results of sporting events, such as, for example, a soccer game or a basketball game.

Users of system 100 may place one or more bets on an in-play game. Each game is a tournament between the users. Winners are determined on the basis of right and wrong wages made by the users, the prize pool, the entry fee, and the total amount of money wagered. In general, instead of real money, winners wage points or tokens, and receive (in winnings) points in tokens. Points and tokens are the same for everyone independent of the currency used to acquire them initially.

In one embodiment, each bet is assigned to one of a number of sporting events. Funds associated with each bet are included in a wager pool associated with the sporting event to which that bet is assigned. The outcome of each bet is determined based at least in part on the results of the sporting event to which that bet is assigned, such as, for example, whether one or the other team (or a particular soccer player on the field) will get a goal, how many, and/or in which half. For each winning bet, a payout is determined from the wager pool associated with the sporting event the winning bet was assigned.

System 10 includes a betting system platform 12, a plurality of clients 14, and one or more wager pool hosts 16. Clients 14 are coupled to betting system platform 12 via a communication network 18 to provide users 20 with access to betting system platform 12.

Betting system platform 12 may be generally operable to manage bets 26 received from users 20 of clients 14. In one scenario, wager pool hosts 16 are coupled to betting system platform 12 via a communication network 22. Each wager pool host may host one or more wager pools 30.

In an exemplary embodiment, betting system platform 12 functions as an Internet betting provider that provides Internet account wagering by providing online betting accounts to clients 14.

Using an online betting account, a client 14 may interface with one or more web sites via an appropriate browser 15 connected to a user created account at a corresponding online gaming operator 28 associated with betting system platform 12 in order to fund the account, view betting information regarding betting events, and place bets 26. Such online betting accounts may include one or more various types of accounts, such as deposit accounts, credit accounts, stop-loss accounts, and hybrid accounts, for example. Communication network 18 couples and facilitates wireless or wireline communication between clients 14 and betting system platform 12, while communication network 22 couples and facilitates wireless or wireline communication between pool hosts 16 and betting system platform 12.

Each communication network 18 and 22 may include one or more servers, routers, switches, repeaters, backbones, links and/or any other appropriate type of communication devices coupled by links such as wireline, optical, wireless, or other appropriate links. In general, each communication network 18 or 22 may include any interconnection found on any communication network, such as a local area network (LAN), metropolitan area network (MAN), wide area network (WAN), the Internet, portions of the Internet, or any other data exchange system. In certain embodiments, communication networks 18 and 22 may be completely distinct, partially overlapping or integrated, or completely overlapping or integrated.

Pool hosts 16 may include any entity suitable to host a wager pool 30. For example, in the embodiment shown in FIG. 1, pool hosts 16 include one or more sporting event locations 44, such as one or more soccer or basketball games, for example.

As shown in FIG. 1, each pool host 16 may maintain one or more wager pools 30, as well as sporting event information 66 for each sporting event associated with that pool host 16. Each wager pool 30 (i.e., sports betting tournament) is a pool of the funds associated with bets 26 assigned to a particular sporting event that is distributed in an at least partially pari-mutuel manner to users 20 who placed winning bets 26.

Pari-mutuel betting is a known betting system in which all bets of a particular type are placed in a pool; taxes and the house-take (platform commission) are removed, and payoff odds are calculated by sharing the pool among all winning bets. Where a maximum amount of winners are allowed per tournament, the winnings are shared in ranked order based on total points collected during the tournament, and not based on whether a winning bet was made alone.

Sporting event information 66 includes various information regarding sporting events scheduled to occur at each sporting event location 44, such as the type of the sporting event, the names of the players, expected odds of goals based on historical information, the scheduled time for the start of the event, and an approximate duration of the event, for example. Each pool host 16 may communicate sporting event information 66 to betting system platform 12 at various times. For example, in certain embodiments, each pool host 16 may communicate sporting event information 66 to betting system platform 12 at the beginning of each day and send real-time or substantially real-time updates for such sporting event information 66 to betting system platform 12 throughout the day and night.

In some embodiments, wager pools 30 are hosted by betting system platform 12 such that the funds associated with bets 26 are not transferred between betting system platform 12 and sporting event locations 44. In other embodiments, wager pools 30 are hosted by both betting system platform 12 and one or more pool hosts 16, such as one or more sporting event locations 44.

As discussed above, betting system platform 12 may be generally operable to manage bets 26 received from clients 14 via communication network 18. Each bet 26 is defined by one or more bet parameters 28 such as the identity of the user 20 who placed the bet 26, a unit stake 29 of the bet 26, the time the bet was placed, the game associated with the bet, the particular type of bet, and one or more selected finishing positions 31, for example. The unit stake 29 of a bet 26 represents the amount that the user 20 placing the bet wishes to wager on the bet 26. The unit stake 29 may be defined as a monetary value, such as in dollars or pounds for example, as a number of betting credits, points, tokens, or in any other suitable manner.

Betting system platform 12 may include a processor 50 coupled to a memory 52 and is generally operable to manage bets 26 received from users 20 of clients 14. Processor 50 is generally operable to execute various algorithms or calculations to determine various data such as game inputs 34, bet results 40, pool values 53 of each wager pool 30, and payouts 42, for example. Processor 50 may comprise any suitable processor that executes a betting system software application 54 or other computer instructions, such as a central processing unit (CPU) or other microprocessor, and may include any suitable number of processors working together.

Memory 52 may comprise one or more memory devices suitable to facilitate execution of the computer instructions, such as one or more random access memories (RAMs), read-only memories (ROMs), dynamic random access memories (DRAMs), fast cycle RAMs (FCRAMs), static RAM (SRAMs), field-programmable gate arrays (FPGAs), erasable programmable read-only memories (EPROMs), electrically erasable programmable read-only memories (EEPROMs), microcontrollers, or microprocessors.

Memory 52 is generally operable to store various information that may be used by processor 50 in determining game inputs 34, bet results 40, pool values 53 of each wager pool 30, and payouts 42. For example, memory 52 may comprise any suitable number of databases, which may be co-located or physically and/or geographically distributed. In the example shown in FIG. 1, memory 52 may store any or all of the following: account information 60 for users 20; leader ranking information 61 for users 20; information 62 regarding bets 26 received from users 20; sporting event information 66; event results 32; game inputs 34; a set of rules 36 for each game offered by betting system platform 12; bet results 40; payouts 42; and pool values 53 of wager pools 30 hosted by pool hosts 16.

Account information 60 may include various information regarding one or more accounts maintained for each user 20 of system 10, such as, for example, personal information regarding the user 20, an account ID, a user password, the type of each account maintained for the user 20, and an account balance 64 for each account. In certain embodiments, account information 60 for each user 20 may be managed by betting system platform 12. For example, betting system platform 12 may manage the account balance 64 for each account associated with a user 20, which may include, for example, adding funds received from users 20, moving funds between accounts and wager pools 30 as appropriate, and allowing users 20 to withdraw funds from their accounts.

Leader ranking information 61 regarding users 20 may include the currently updated ranking of a user among all active user accounts, or from among those users who currently have at least one outstanding bet 26. The leader ranking information can be inclusive of all users with active accounts on the betting system platform, or limited only to users of the online gaming operator 28 to which a user is registered.

Bet information 62 on received bets 26 may include parameters 28 defining each bet 26 received from a user 20. Example parameters include the identity of the user 20 that placed the bet 26, the unit stake 29 of the bet 26, the time the bet is received by betting system platform 12, the game associated with the bet, the particular type of bet, and one or more selected finishing positions 31. In addition, bet information 62 on each bet 26 may identify other information regarding the bet 26: such as the wager pool 30 (if any) to which the bet 26 is assigned by betting system platform 12; the status of the bet 26, such as whether the bet 26 is pending, completed or cancelled, and if the bet 26 was completed, the bet result 40 of the bet 26 (for example, whether the bet 26 was determined a win, loss, or push); and the status of the funds associated with the bet 26.

As discussed above, sporting event information 66 includes information regarding various sporting events. Betting system platform 12 may receive sporting event information 66 from pool hosts 16 at various times. For example, as discussed above, in certain embodiments, betting system platform 12 may receive sporting event information 66 from each pool host 16 at the beginning of each day, as well as receive real-time or substantially real-time updates to such sporting event information 66 throughout the day and night. Thus, sporting event information 66 maintained by betting system platform 12 is kept substantially up to date.

Further details of the invention shall now be described with reference to screenshots shown In FIGS. 2-9.

FIGS. 2-5 show screenshots 200-500, respectively, generated by the betting system platform and displayed on a local client device to provide game explanations in accordance with an exemplary embodiment.

Figure 2:
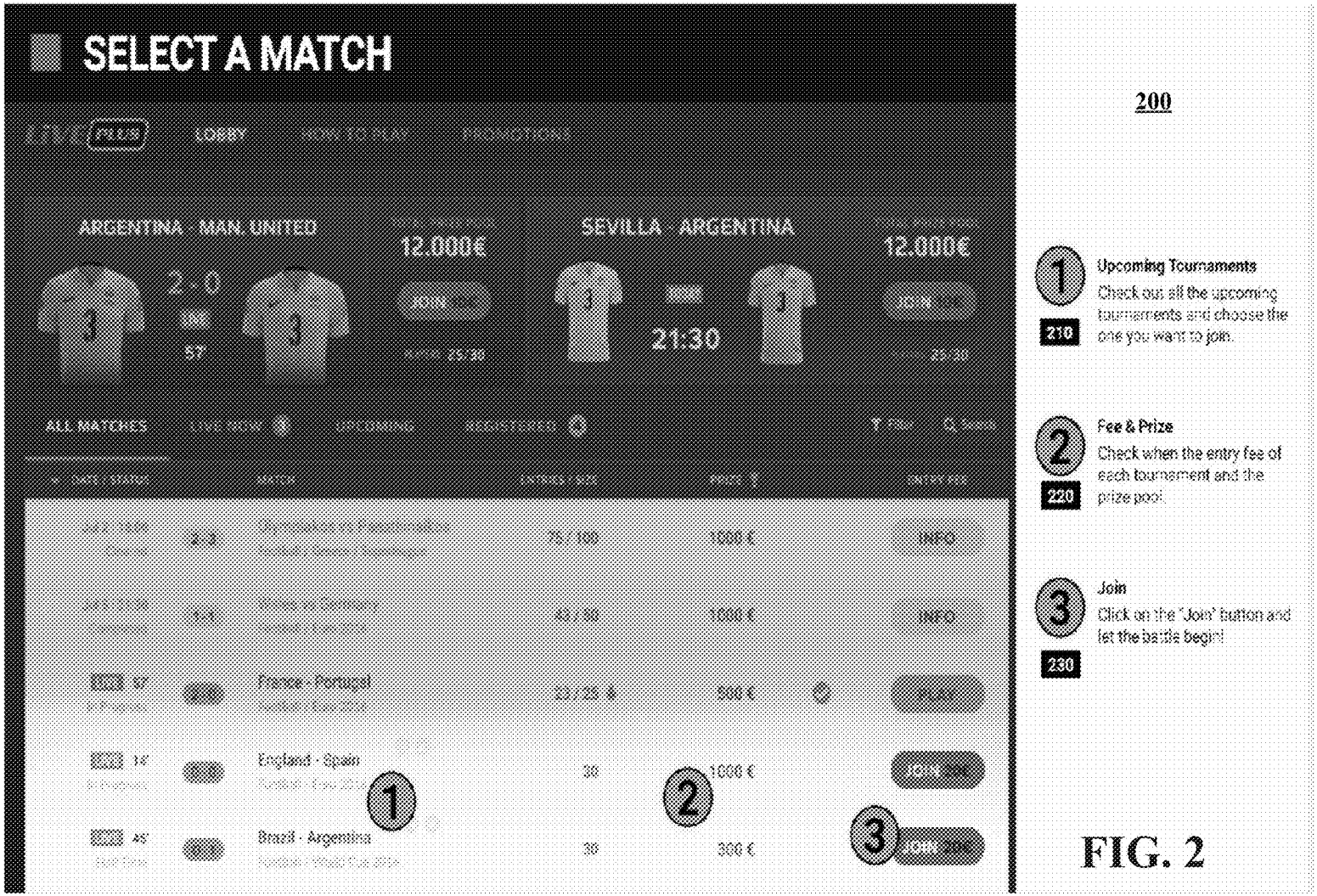
FIGS. 2-5 show screenshots generated by the betting system platform and displayed on a local client device to provide game explanations in accordance with an exemplary embodiment.

Referring to FIG. 2, screen shot 200 explains the tournament selection process. Item 1 is a blown up example partial view 210 of four tournaments. Item 2 is a blown up view 220 of an example entry fee indicator. Each tournament has a corresponding entry fee and a prize pool. In one scenario, a tournament is possible only when a sufficient number of users have agreed to participate. For an example prize pool of 500 euro, with a ten (10) euro entry fee, 50 users must join. Should more than 50 users desire to play, the prize pool amount is increased accordingly; unless according to tournament rules, the tournament is closed to new players wishing to join, once the tournament player capacity is met. To join, a member is requested to click on the "JOIN" link 230 shown in item 3.

Figure 3:
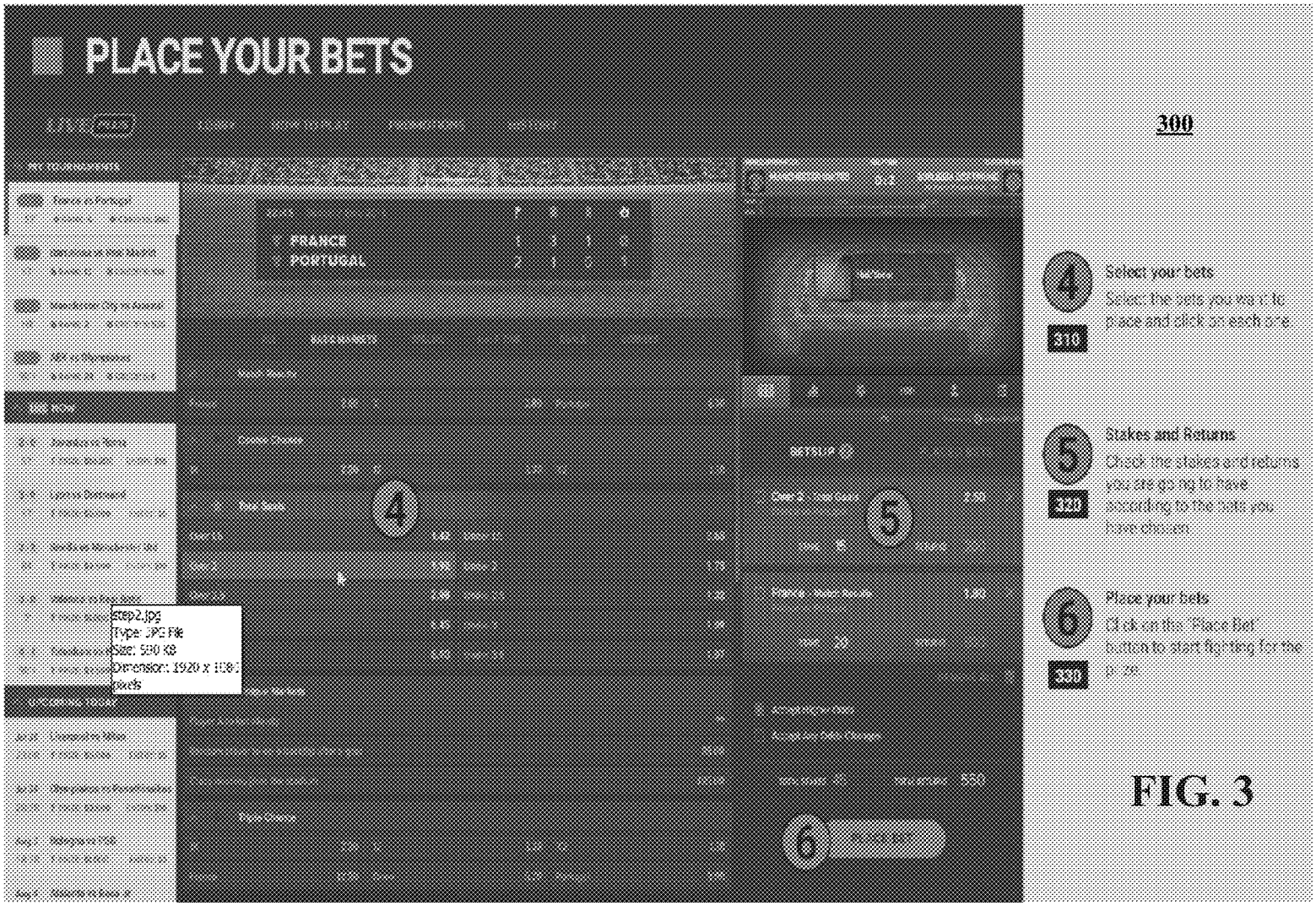

Referring to FIG. 3, screen shot 300 explains how bets are placed once a member has joined a tournament. Item 4 is a blown up view 310 of an example bet type and the odds associated with that bet. Item 5 points to section 320 showing the stakes and associated cash value return a player should expect for a given placed bet. To place a bet, a tournament participant is requested to click on "PLACE BET" link 330 shown and descried in connection with item 6.

Figure 4:
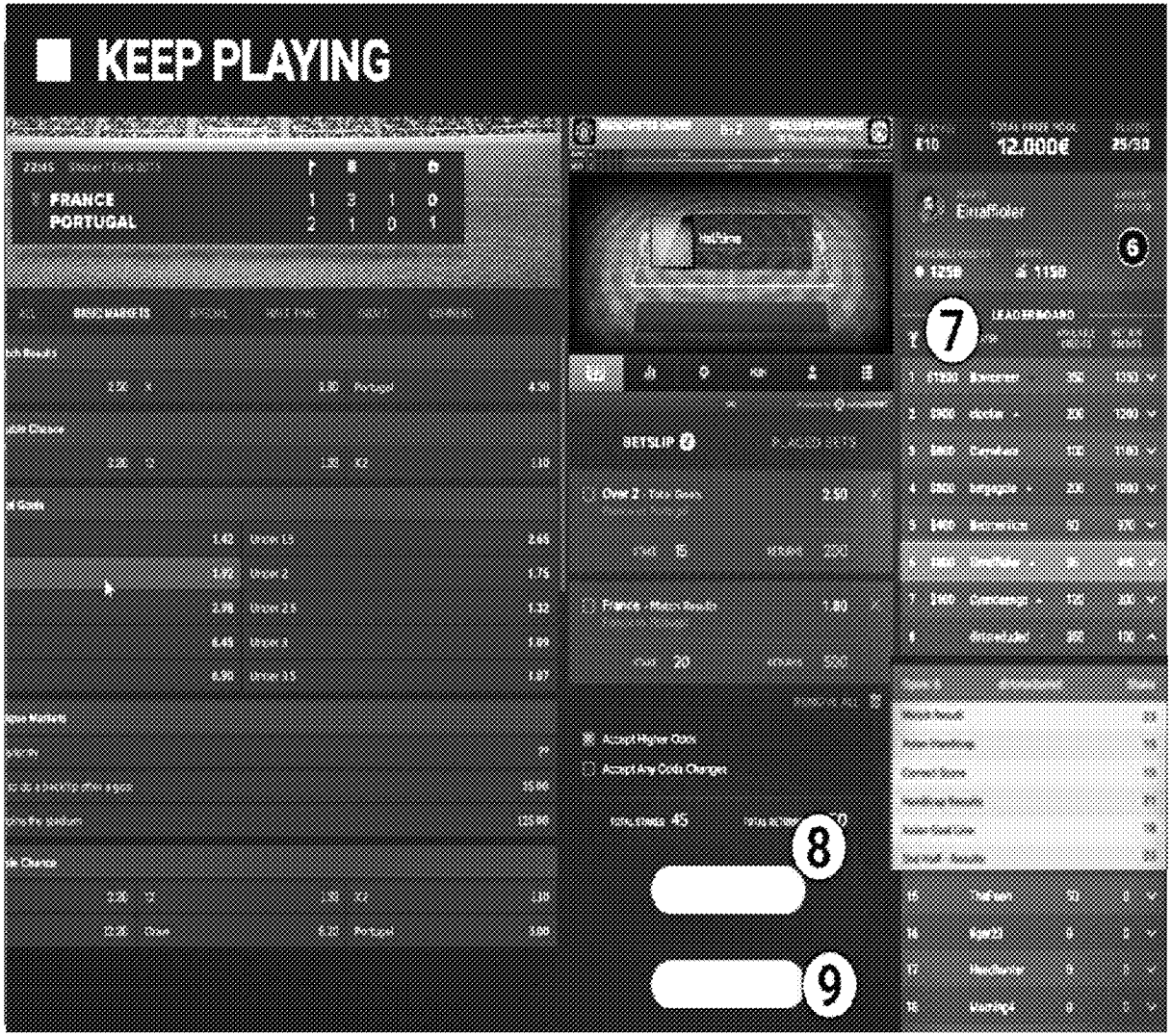

Referring to FIG. 4, screen shot 400 displays the real-time progress data presented to a tournament player during in-play activity. Here, it should be appreciated that a tournament closes or expires only after the game is ended. This is because tournament members are permitted to make bets throughout the game, including making new bets. This helps members increasing their chances to rank higher on the leaderboard 420 shown and described in connection with item 7.

The leaderboard aspect is a key feature of the present invention for a number of different reasons. First, leaderboard 420 communicates to members who desire to place a new bet who else has already bet and how well these other players are performing. For many players, this information provides an additional level of strategy, in terms of how to place ones future bet. For example, a player that is a long standout in the rankings may be difficult to beat. In such a tournament, one might consider following the future or not-yet-expired bets of the leader player in a given tournament, possibly assuring oneself of a chance of placing on the leader board once all the bets are in and closed. Another option is to stay back and play conservatively. Some may play more aggressively. Some may not play at all. Whatever the move, the leaderboard provides significant added value for some players.

Leaderboard 420 is dynamically updated after an in-play bet is closed. For example, I bet that team player X will make the next team goal in the first half. This bet inherently closes when either player X makes a goal in the first half (a "win"), someone other than player X makes a goal first (a "loss"), or the half comes to a close (also, a "loss"). Independent of how or when people place bets at any given time during a game, leaderboard stats are updated in real-time to accurately reflect wager pool standings on the leaderboard. When joining a tournament, a player is provided with funds. In one scenario, funds convert to points or tokens. For example, a 10 euro entry fee—expressed in points—is 100 points. Of course, player deposits may also be expressed in the currency denomination designated at the time of deposit, or in a different currency denomination depending on (i) the location of the player, or (ii) on the basis of any player default preferences or selections, or (iii) even on the basis of any platform- or tournament-specific currency denomination default preference.

Assuming a minimum bet amount of 100 per bet, a player can place two 100-point bets at any time during in-play betting. Item 8 at link 430 allows a player to add a bet during in play. If the tournament player has placed two bets and lost both of them, and other players have ranked on the leaderboard so the prize pool money is available to the rest, the tournament player is eliminated by default. The only way to continue to play is to request a rebuy option (item 9).

Figure 5:
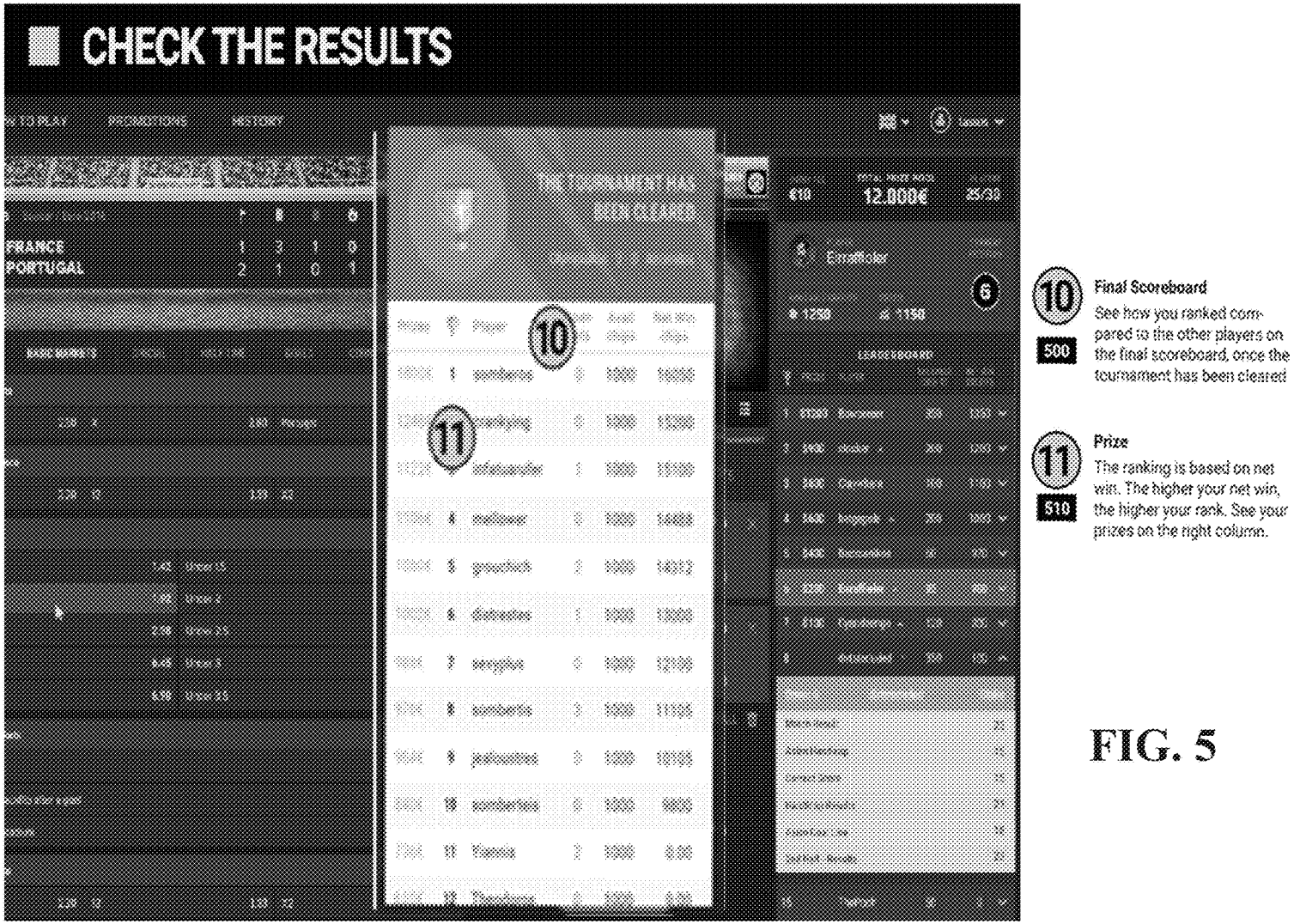

Referring to FIG. 5, screen shot 500 explains what a tournament player can expect to see on the leaderboard once the tournament has cleared. Item 10 is a blow up of the top picks and current standings among tournament players (at least those that placed/won). Section 510 corresponding to item 11 shows how the prize pool monies is to be finally distributed by the platform now that the tournament is over. Provided links to each tournament winner makes it possible to view the bets and strategy of each winning player in addition to seeing how much money is won.

In theory, a player who wagered and lost fewer points than another player may rank higher on the leaderboard and actually make more money than wagered and without winning. From a value-add perspective, the use of the leaderboard for the first time provides a significant money management incentive for players, which translates into greater interest in tournament style in-play sports betting. Greater interest in tournament style betting increases both overall number of players and wagering amounts with no balanced book exposure for the betting system platform. For online gaming operators linked to the betting system platform, the increased player usage and exposure, allows operators (particularly smaller operators) to promote in-play tournament style sports betting with low or no bonus incentives, and with little of the risk or cost associated with traditional in-play sports betting.

Figure 6:
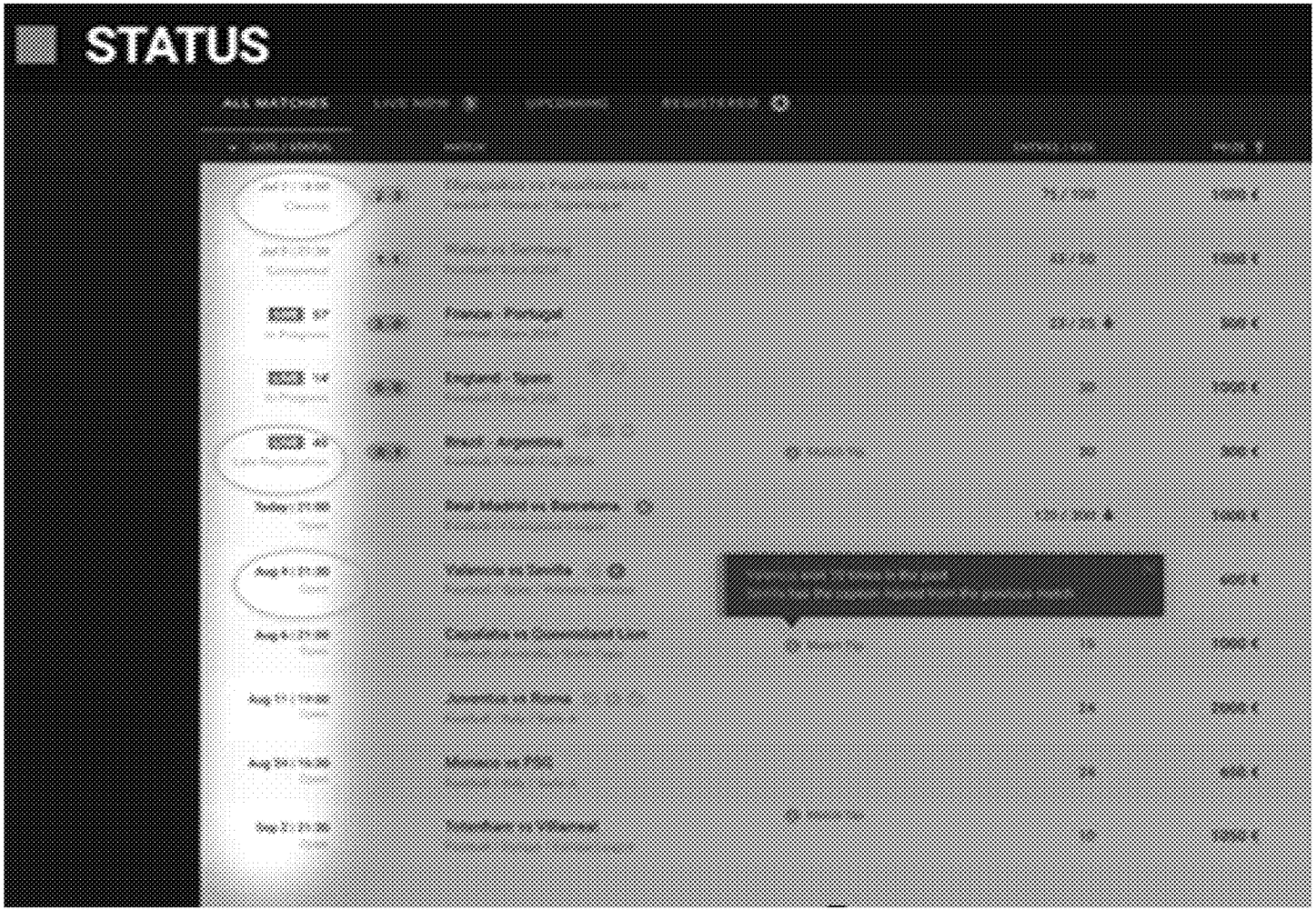
FIG. 6 is a screenshot showing all the tournaments available for which sports betting information is currently available.

FIG. 6 is a screenshot 600 showing all the tournaments available for which sports betting information is currently available. The list includes already cleared games that allow players to view leaderboard rankings, who wagered what, and what prize pool earnings are generated, among other things. The list includes open registration tournaments, as well as tournaments for games not yet in play (open).

Figure 7:
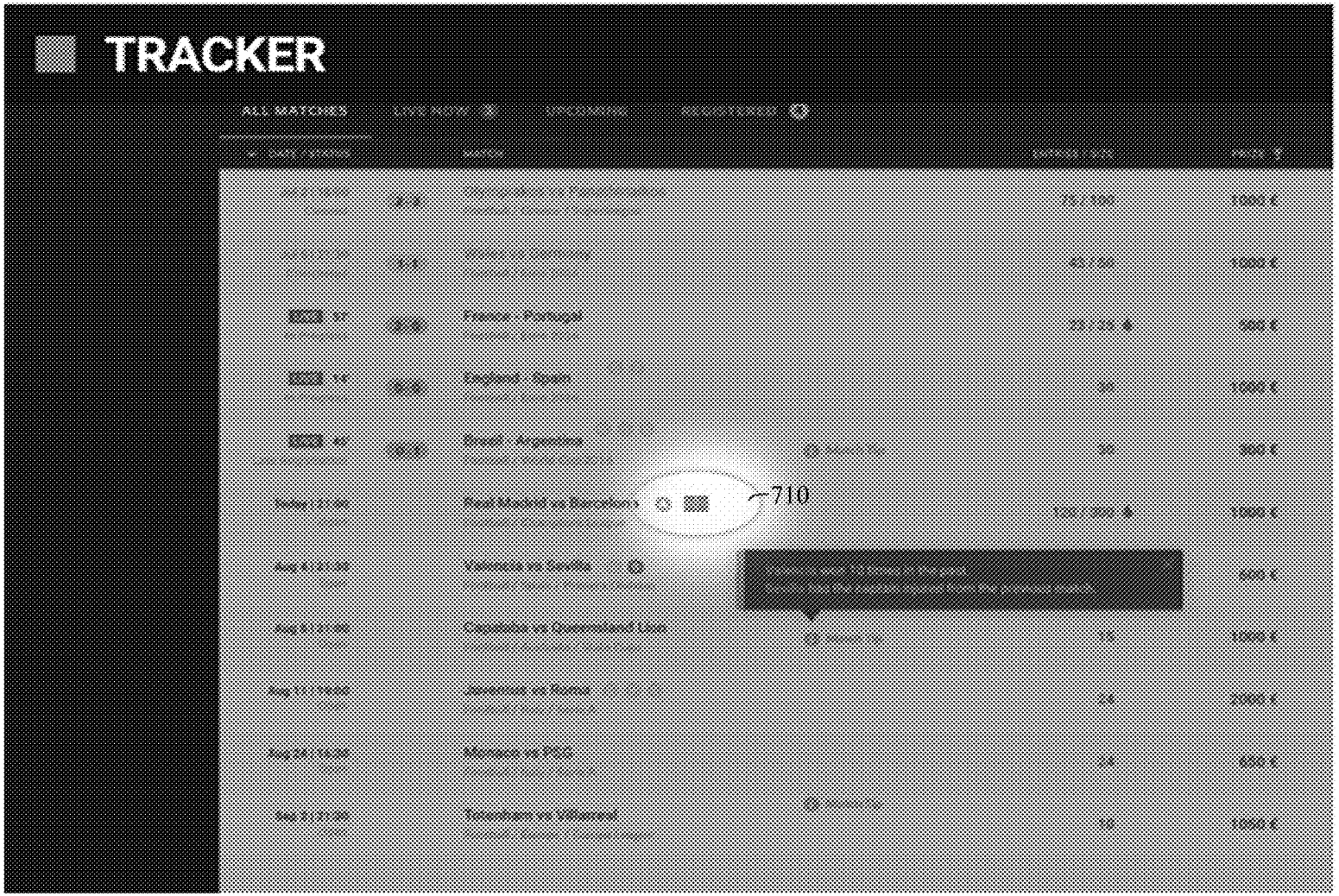
FIG. 7 is a screenshot showing "LIVE" match information for those players interested in joining a game in play.

FIG. 7 is a screenshot 700 showing "LIVE" match information for those players interested in joining a game in play. The score, time left, team info, entry fee, number of entries, and a JOIN link are some of the information available for the game in play. Item 710 is an icon indicating there is a tracker available for the specific tournament. In one scenario, the tracker is located on the upper right corner of the live betting tournament screen and offers an extended version of traditional non-tournament play including the attack visualization and positional data of all important match events like goals, corners, goal kicks, freekicks, shots, cards, injuries, throw-ins, etc.

Figure 8:
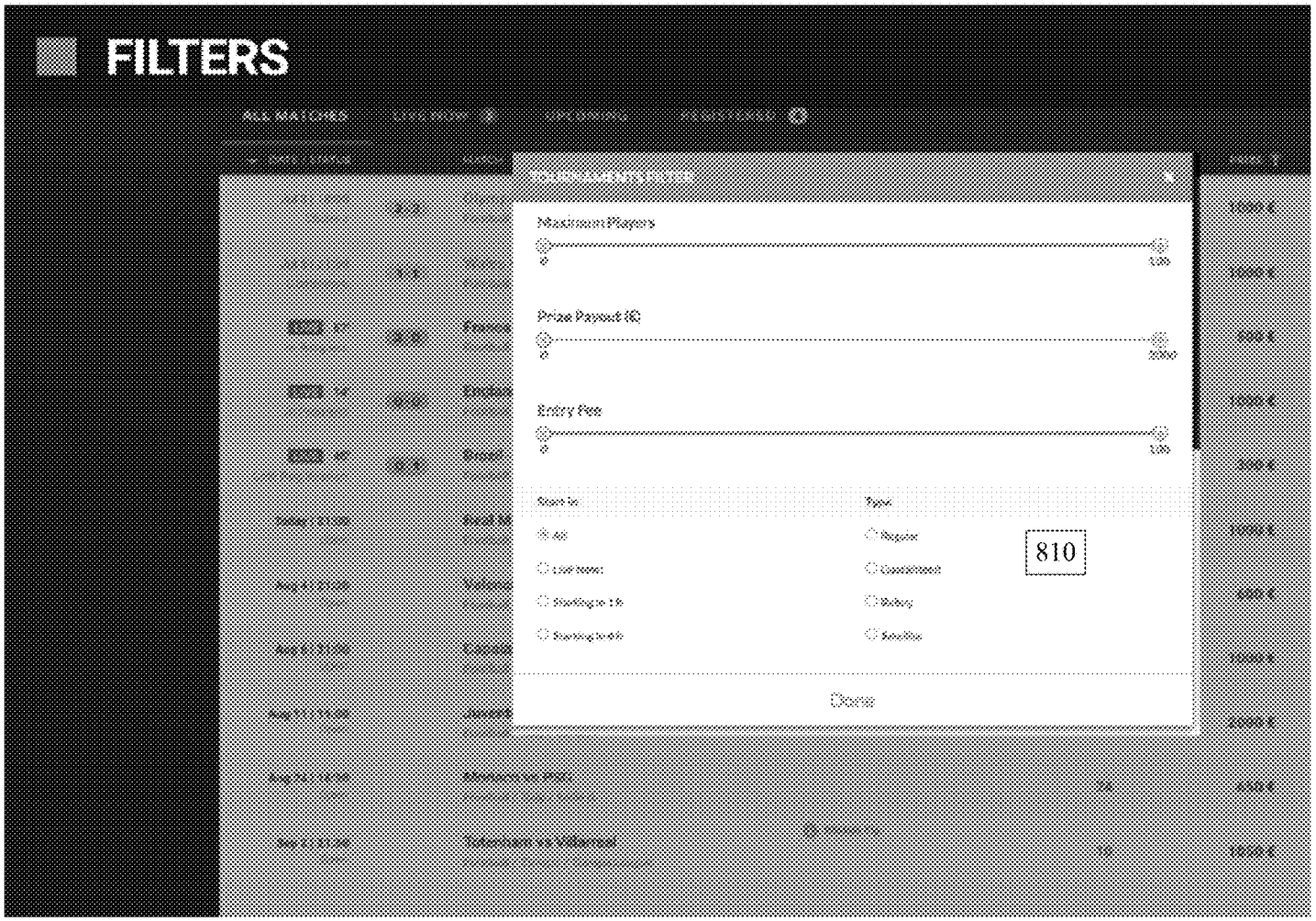
FIG. 8 is a screenshot showing selected UPCOMING match information.

FIG. 8 is a screenshot 800 showing selected UPCOMING match information. Selection tool bar 810 allows players to selectively call up screens to display: ALL games, regular games, guaranteed games, satellite only games, and freeroll games.

A Guaranteed {G} indicator is a tournament where the prize pool money is guaranteed by the betting system platform. For example, if there is a 5000 euro guaranteed tournament there will always be at least 5000 euro in the prize pool. If the amount gathered is more than the guaranteed prize pool, the total money pool increases according to the buy-ins, rebuys and/or the add-ons amount. In cases, where there are not enough players in order to cover a prize pool for a given tournament, the platform will cover the remainder of the guaranteed amount. By guaranteeing prize pool monies in this way, players are incentivized to seek out tournament playing, which reduces the likelihood that the platform will need to guarantee anything in the end due to the increased player interest and wager volume.

A Rebuy {R} option lets players know they can buy additional when they run out of chips during tournament play.

A Freeroll {F} is an incentive and promotion feature. Typically, a freeroll is a tournament where the buy-in and the tournament fee is €0. The prize pool of the freeroll is guaranteed and normally neither bigger nor smaller than declared in cases where no rebuys or add-ons are available. Freeroll prize pool may consist of real or play money, entry tickets to other tournaments or merchandise.

Figure 9:
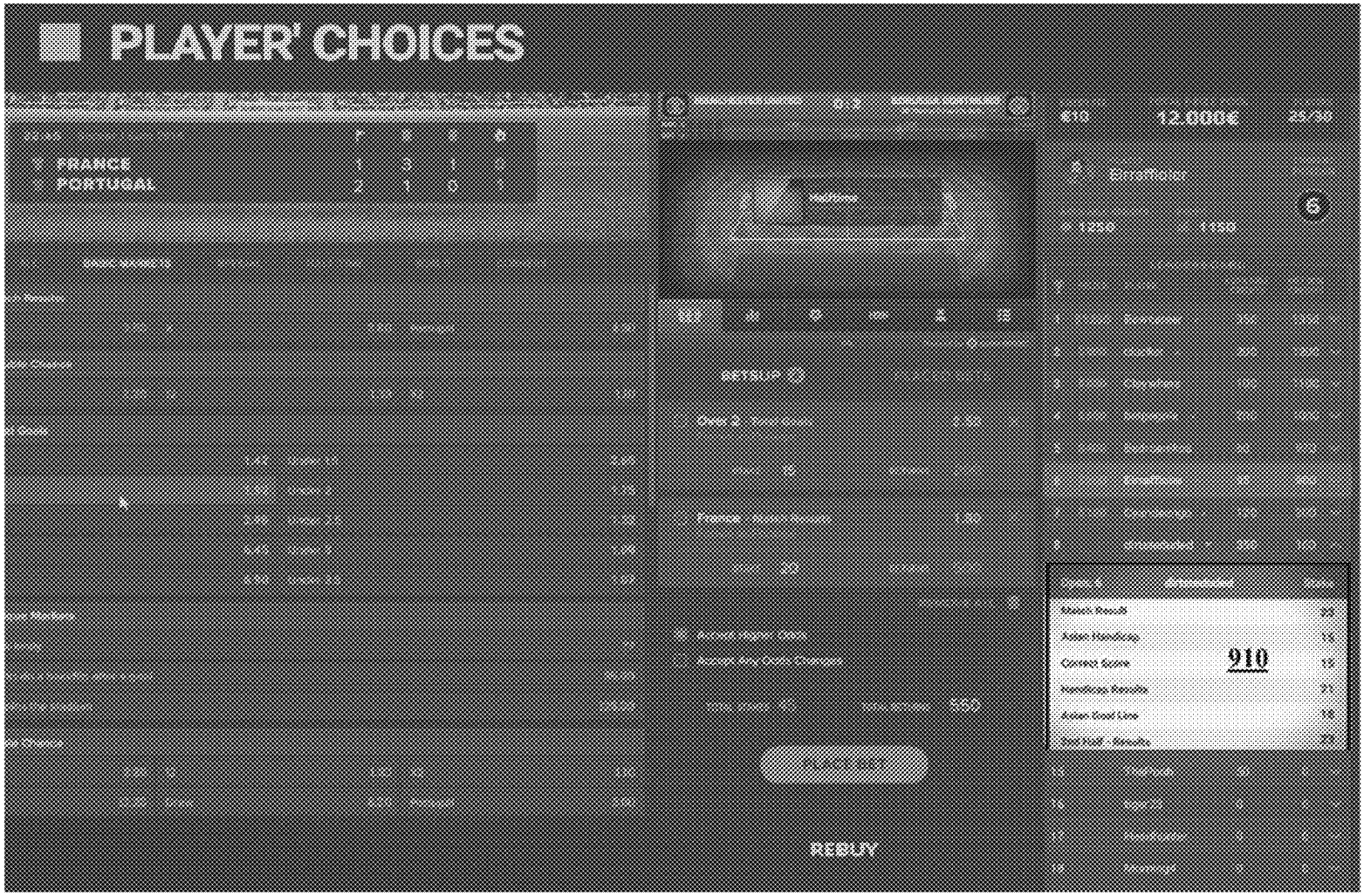
FIG. 9 is an example screenshot showing the bets wagered by first place tournament winner.

FIG. 9 is an example screenshot 900 showing the bets placed by player ('playfulllogger') anked first on the leaderboard. Pop up 910 shows in detail the bet types made by player "playfulllogger", the odds awarded to him at the time of each bet, the amount wagered and amount won.

In an exemplary embodiment, an email, SMS or like communication is sent to the player to confirm bets placed by him in order to reduce or eliminate mistaken and unauthorized bets.

As envisioned, the leaderboard ranking is updated in real-time in streaming fashion. In addition to instant access to standings throughout tournament play, a variety of color cues and number combinations may be employed to indicate a change in rankings in a quick and user-friendly manner, and also how many spots on the rankings a player moved during a change. For example, an indicator of +13 next to a leaderboard standing for a given player might indicate that the player's position in a current spot was moved UP thirteen positions since the last leaderboard update.

Figure 10:
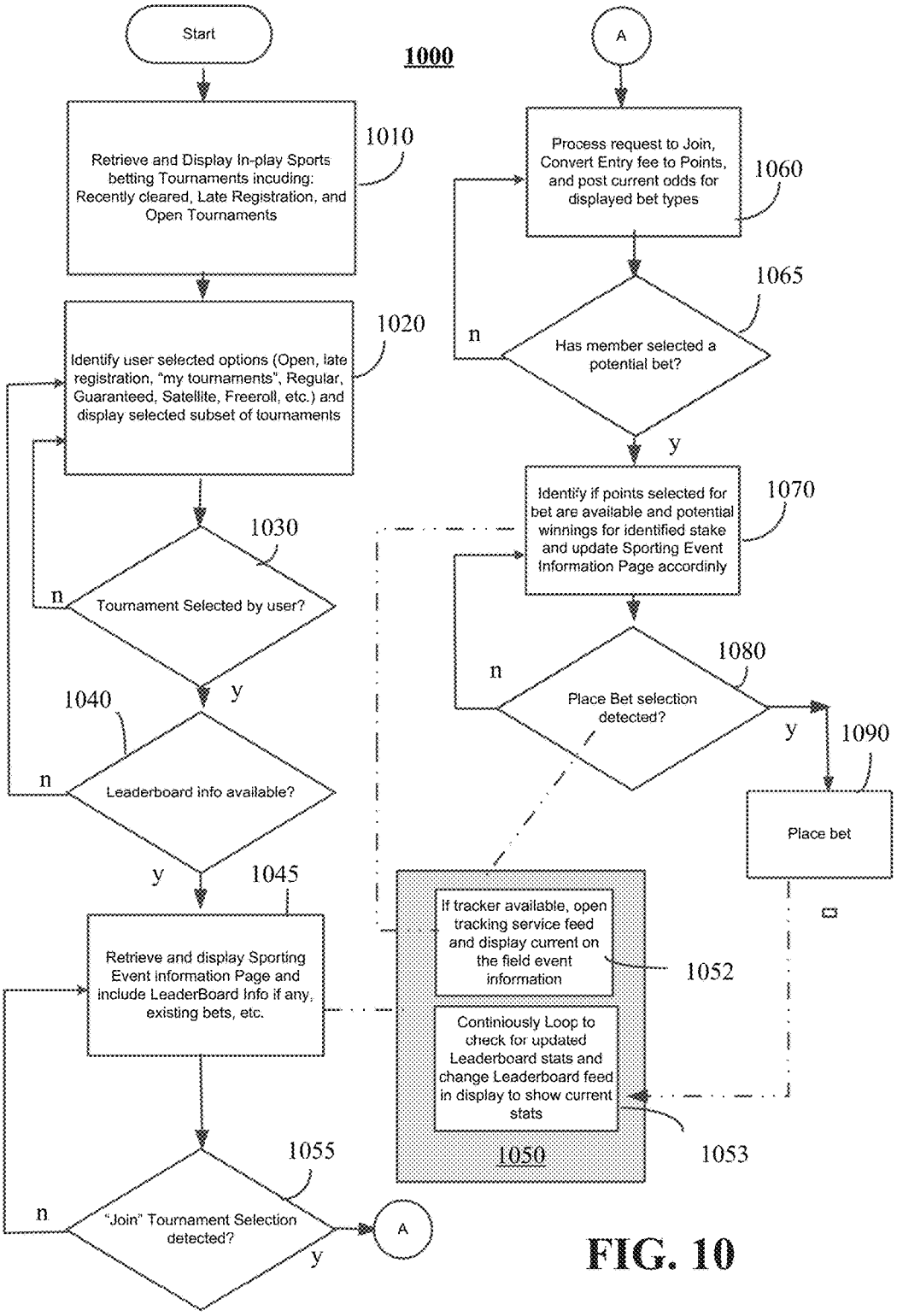
FIG. 10 is a high level operational flow diagram of the methodology employed by the betting system platform in accordance with an exemplary embodiment as proposed herein.

FIG. 10 is a high level operational flow diagram 1000 of the methodology employed by betting system platform 12 in accordance with an exemplary embodiment as proposed herein.

A user wishing to play tournament style in-play sports betting as proposed herein joins an online gaming operator offering in play betting via an appropriate link to a betting system platform. The member logs into the online gaming operator where he is guided to wager on tournament style in-play sports betting. The same operator may offer other gaming services including traditional live betting and in-play betting. In an alternate scenario, the member logs in directly to the betting system platform which may offer its own direct service to players.

Once engaged, typically via a browser, and logged in to the betting system platform, the platform is ready to serve up tournaments for the player to wager.

As a first step, the platform retrieves and displays (via an initial home screen) up to date in-play sports betting tournaments. The home screen may show all relevant tournaments including recently cleared tournaments, late registration available tournaments, as well as open tournaments (step 1010).

In a next step, the platform identifies which of the available tournament selection options the member wishes to view and displays only those tournaments. In one scenario, the selection options include displaying user's pending "my tournaments", all regular tournaments, guaranteed type tournaments, satellite feed tournaments which may be available to watch live while real time wagering, as well as freeroll or other system defined tournaments or tournament options (step 1020).

The platform then waits for a user tournament selection (step 1030). Once a selection is detected, the platform queries its database records to see whether the particular tournament is one for which a leaderboard exists (assuming the game is in play); or, alternatively, whether past leaderboard information is available to serve to the user from previous cleared tournament data (step 1040).

The platform finally retrieves all remaining sporting event information for a selected tournament (step 1045) and displays this together with the currently relevant leaderboard info, currently pending user bets for the selected tournament. If a tracker of event live feed information is available from a third part source, the tracker feed is loaded and displayed as well. While the information is digested by the user in preparation for making a bet, in parallel, the platform invokes a routine 1050 which continuously loops to ensure that the most current tracking and bet information (including real time changes to Odds per bet) 1052 are provided. Separately, routine 1050 keeps track of expired, settled and cleared bets during in play sports betting and appropriately updates the leaderboard info so that the information displayed is current (1053).

Once a decision is detected indicating that the user presently desires to "join" the previously identified tournament (step 1055), a process request is placed by the platform which causes settlement of the user entry fee for the now "joined" tournament; as well as a conversion, if necessary, of the user entry fee into points or tokens, whichever is appropriate. Of course, as with step 1045, routine 1050 runs in the background ensuring updated sporting event information is served for viewing (1060).

At this point, as contemplated herein, the user will have a unique opportunity as never before to research—by looking at the leaderboard—bets placed by others, and if a game is in play, how well those bets have fared so far. This information provides a clear advantage and an added player-strategy resource to better manage winnings and losses by varying future bets accordingly.

Once a decision is detected indicating the user desire to place a particular bet (1065), once again, the platform confirms that the bet amount is within allowed limits or available balances for the tournament (1070), and if so (1080), the bet is placed (1090).

Once a bet is placed, the player remains online if he so chooses and continues to be served real-time, up to date betting and leaderboard statistics allowing him to better manage his bets, adding to them if need be, based not only on what's happening on the field, but as importantly, based on what other tournament players are doing.

The additional access to leaderboard information, coupled with the inherent risk limiting benefits of tournament playing, enhances both the wagering experience for the players.

By appealing to a wider audience, smaller online venues are given an alternative to traditional, high risk, expensive sports betting. As leaderboard focused sports betting tournament style approach becomes popular, it is believed that interest in sports betting will wane significantly.

Various embodiments of the invention are described above in the Detailed Description. While these descriptions directly describe the above embodiments, it is understood that those skilled in the art may conceive modifications and/or variations to the specific embodiments shown and described herein.

Any modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s).

The foregoing description of a preferred embodiment and best mode of the invention known to the applicant at this time of filing the application has been presented and is intended for the purposes of illustration and description. It is not intended to be exhaustive or limit the invention to the precise form disclosed and many modifications and variations are possible in the light of the above teachings.

The embodiment was chosen and described in order to best explain the principles of the invention and its practical application and to enable others skilled in the art to best utilize the invention in various embodiments and with various modifications as are suited to the particular use contemplated. Therefore, it is intended that the invention not be limited to the particular embodiments disclosed for carrying out this invention, but that the invention will include all embodiments falling within the scope of the appended claims.

In one or more exemplary embodiments, the functions described may be implemented in hardware, software, firmware, or any combination thereof. If implemented in software, the functions may be stored on or transmitted over as one or more instructions or code on a computer readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blue-ray disc where disks usually reproduce data magnetically, while discs reproduce data optically with lasers. Combinations of the above should also be included within the scope of computer-readable media.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. In a system including a betting system platform consisting of a data processor coupled to a memory and a webserver cooperatively configured to facilitate in-play sports betting, a method of facilitating in-play sports betting executable by the data processor, comprising:

identifying a request by a player to join a tournament with a predefined entry fee, where each tournament is a wager pool of players betting on a live sporting event;

displaying sporting event information including different bet types that can be waged on the basis of the predefined entry fee, and updating the sporting event information in real time in response to in play activities associated with the live sporting event;

simultaneously making available for display leaderboard information including information about the bets waged on by those on the leaderboard; and automatically updating the leaderboard in response to previously placed bets settling or clearing, wherein the updated leaderboard information is available to the player at all times during in play betting and wagering, the betting system platform updating the sporting event information in response to information received from a third-party book maker service, which updates odds for each bet type throughout the tournament in response to the in-play activities and factors related to the live sporting event.

2. The method of claim 1, further comprising presenting at least two tournaments to the player to choose from, with at least one of the tournaments being a guaranteed tournament.

3. The method of claim 2, wherein the betting system platform is configured for access by a web browser from a client device of the player.

4. The method of claim 2, wherein the leaderboard information includes information indicating a change in leaderboard rankings of players in response to settling of bets.

5. The method of claim 4, wherein the information indicating a change includes a colored number indicator.

6. The method of claim 1, wherein the betting system platform is configured for access by a web browser from a client device of the player.

7. The method of claim 1, wherein the leaderboard information includes information indicating a change in leaderboard rankings of players in response to settling of bets.

8. The method of claim 7, wherein the information indicating a change includes a colored number indicator.

9. An apparatus for facilitating in-play sports betting comprising:

at least one processor; and a memory electronically coupled to the at least one processor, wherein the memory stores instructions which, when executed by the at least one processor, direct the at least one processor to:

identify a request by a player to join a tournament with a predefined entry fee, where each tournament is a wager pool of players betting on a live sporting event;

display sporting event information including different bet types that can be waged on the basis of the predefined entry fee, and updating the sporting event information in real time in response to in play activities associated with the live sporting event;

simultaneously make available for display leaderboard information including information about the bets waged on by those on the leaderboard; and automatically update the leaderboard in response to previously placed bets settling or clearing, wherein the updated leaderboard information is available to the player at all times during in play betting and wagering, wherein the processor is configured to update the sporting event information in response to information received from a third-party book maker service which in turn updates odds for each bet type throughout the tournament in response to the in-play activities and factors related to the live sporting event.

10. The apparatus of claim 9, further directing the processor to present at least two tournaments to the player to choose from, with at least one of the tournaments being a guaranteed tournament.

11. The apparatus of claim 10, wherein the apparatus is configured to be accessed by a web browser from a client device of the player.

12. The apparatus of claim 10, wherein the leaderboard information includes information indicating a change in leaderboard rankings of players in response to settling of bets.

13. The apparatus of claim 12, wherein the information indicating a change includes a colored number indicator.

14. The apparatus of claim 9, wherein the apparatus is configured to be accessed by a web browser from a client device of the player.

15. The apparatus of claim 9, wherein the leaderboard information includes information indicating a change in leaderboard rankings of players in response to settling of bets.

16. The apparatus of claim 15, wherein the information indicating a change includes a colored number indicator.

* * * * *